US007210488B2

(12) United States Patent
Desormeaux

(10) Patent No.: US 7,210,488 B2
(45) Date of Patent: May 1, 2007

(54) SOLIDS SEPARATION SYSTEM

(75) Inventor: Kenny Desormeaux, Lafayette, LA (US)

(73) Assignee: OCS Technologies, LLC, Abbeville, LA (US)

( * ) Notice: Subject to any disclaimer, the term of this patent is extended or adjusted under 35 U.S.C. 154(b) by 121 days.

(21) Appl. No.: 11/013,508

(22) Filed: Dec. 16, 2004

(65) Prior Publication Data

US 2006/0130879 A1 Jun. 22, 2006

(51) Int. Cl.
*B08B 3/04* (2006.01)
*B08B 9/093* (2006.01)
*B08B 7/04* (2006.01)

(52) U.S. Cl. ..... 134/22.18; 134/10; 134/13; 134/18; 134/22.1; 134/24; 134/104.1; 134/110; 134/166 R; 134/169 R

(58) Field of Classification Search ..... 134/10, 134/13, 18, 22.1, 22.18, 24, 166 R, 169 R, 134/104.1, 110
See application file for complete search history.

(56) References Cited

U.S. PATENT DOCUMENTS 4,828,625 A * 5/1989 Moran ..... 134/22.18
5,876,512 A 3/1999 Desormeaux et al.

* cited by examiner

*Primary Examiner*—Zeinab El-Arini
(74) *Attorney, Agent, or Firm*—Keaty Professional Law Corporation

(57) ABSTRACT

A solids removal system for use in removing sand and silt from well production fluids. The system has a manifold assembly provided with jetting nozzles, which is installed in a liquid and solids-containing vessel, where solids have settled in the walls. The jetting nozzles deliver, in a pre-determined sequence, a solids-dislodging fluid, causing the solids to become suspended in the fluid. The dislodged solids and fluid are then extracted by pump from the vessel and directed to a solid-fluid separator. Solids-free fluid is returned for re-re-circulation through the vessel, while the solids are moved to a containment location.

9 Claims, 6 Drawing Sheets

SOLIDS SEPARATION SYSTEM

BACKGROUND OF THE INVENTION

The present invention relates to a system of solids separation, and more particularly to a system for separating sand and silt from well bore water used in the oil and gas industry.

Presently, there exist an estimated 5000 oil and gas production facilities in the U.S. Gulf of Mexico alone. All of these facilities employ one type or another of solids separation equipment. Such equipment is necessary to separate each fraction of the produced fuel and gases so that they may be directed in a clean state to their particular means of storage, transportation and ultimate sale. For wells, which produce sand and solids, the separation equipment acts as a collection mechanism for the solids. During drilling or production operation, particles of sand and silt are brought to the surface with the oil gas and produced water. The sand and silt accumulate in the separation equipment creating numerous problems to the equipment owners, including reduction in the separation retention time by displacing gas or volume, blocking free passage of fluids thereby affecting the separation efficiency and carrying over sand to other valves and equipment, thereby increasing wear of the equipment through abrasion and the like.

Sand removal has been an everyday maintenance activity of oil and gas producers since oil production began. However, even today the most common means for removing accumulated sand is to shut in the wells and/or divert the production stream to another separator that can handle the separation while the vessels are opened and cleaned in a conventional process. A conventional process usually involves the use of hydrocyclones and vibrating screen shakers. The conventional process exposes the workers to potentially dangerous conditions including exposure to Benzine, a known carcinogen, and to oxygen deficient atmosphere. Additionally, the explosive environment of the hydrocarbon separation causes the threat of combustion by a simple static spark. Even further, the cost of shutting the well production can reduce the profit of the well owner by millions of dollars a day.

In the 90's, technology was developed to approach the sand removal problem remotely. This technology is disclosed in U.S. Pat. No. 5,876,512 issued on Mar. 2, 1999. That technology, while offering great advances over conventional then-current technology has certain disadvantages as it allows removal of approximately 65% of the solids.

The present invention contemplates elimination of drawbacks associated with the prior art and provision of a solid separation system which can remove substantially all sand and solids from the vessel used in the oil and gas industry under their normal operating conditions.

SUMMARY OF THE INVENTION

It is therefore an object of the present invention to provide a solid separation system for removal of sand and other solids from tanks and containers used in the oil and gas industry.

It is another object of the present invention to provide a solid separation system that can separate the solids based on a "batch" method, allowing the operator to schedule maintenance of the vessel at a predetermined time.

These and other objects of the present invention are achieved through a provision of an apparatus and method for dislodging solids settled in a container. The container may be a standard tank, which contains produced water, sand and solids from a well, with or without hydrocarbons. The system of the present invention comprises a manifold assembly that is manufactured in sections and delivered to the site for positioning in the vessel. The manifold sections are provided with jetting nozzles that deliver a solids-dislodging fluid, for instance sea water, into the vessel.

Each section of the manifold assembly is separately and independently connected, through a respective valve to a control panel, which can be manually or computer-operated. A signal from the control panel directs introduction of the fluid into the manifold section in a pre-determined sequence. The manifold sections are positioned in the vessel for delivery of the fluid to the lower part of the inner chamber, a portion where most of the solids have a tendency to settle. The manifold sections are supported in their selected position by a plurality of tensioned rods mounted between the top surface of the manifold sections and the inside top wall of the vessel.

Dislodged solids and the fluid are extracted by an extraction pump from the container and delivered to a solids/fluid separator, where the sand and silt is finally separated from the dislodging fluid. The fluid is re-circulated back into the manifolds by a high-volume triplex pump, while the solids are delivered to a containment location.

BRIEF DESCRIPTION OF THE DRAWINGS

Reference will now be made to the drawings, wherein like parts are designated by like numerals, and wherein.

DETAILED DESCRIPTION OF THE PREFERRED EMBODIMENT

Figure 1:
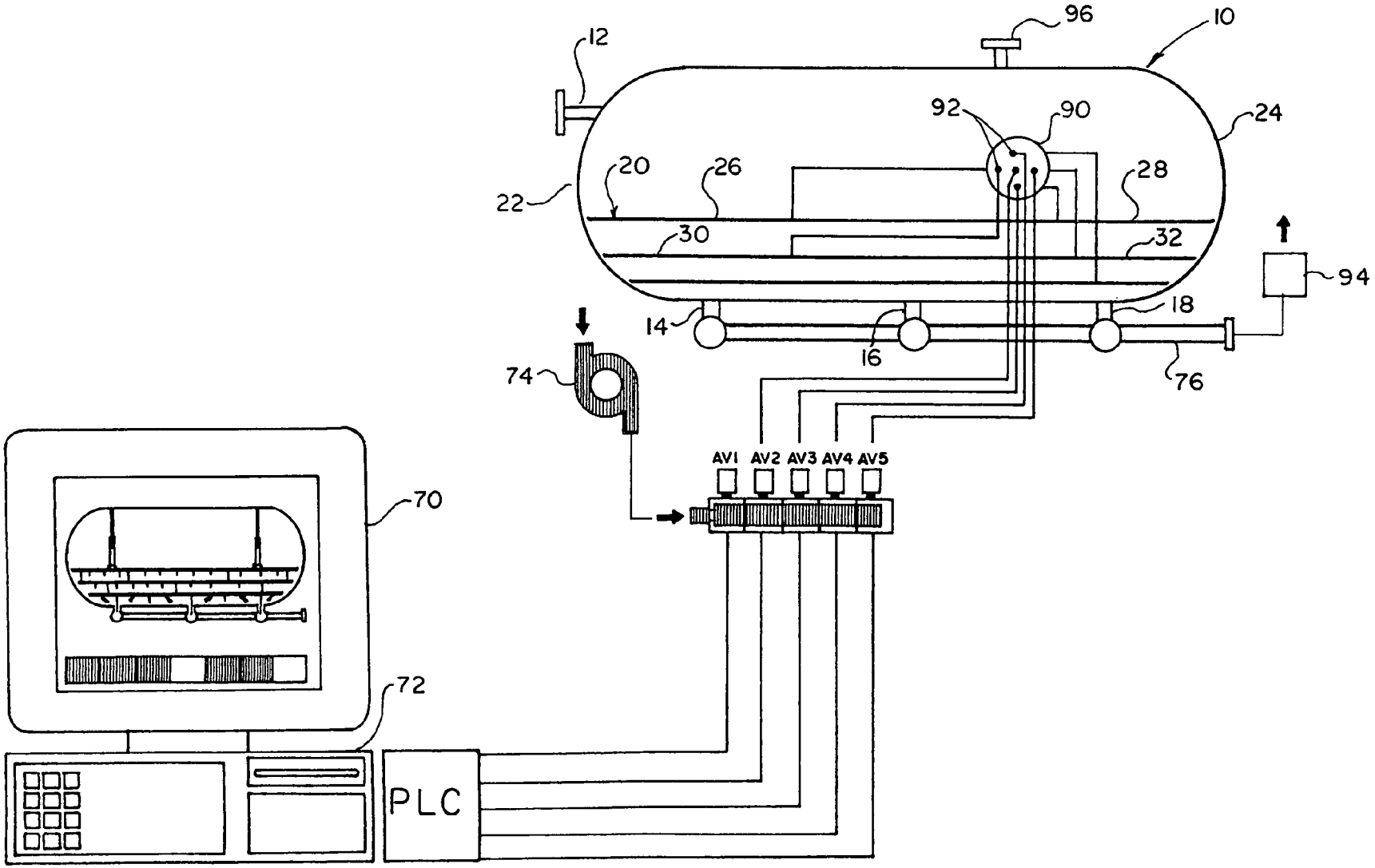
FIG. 1 is a schematic view of the solids separation system in accordance with the present invention.

Turning now to the drawings in more detail, numeral 10 designates a vessel, tank or other container, wherein the well water containing solid particles and perhaps some hydrocarbons is delivered. The vessel 10 has an inlet 12 located at the top of the vessel and a plurality of outlets 14, 16 and 18 located in the bottom of the vessel. The vessel 10 may also have a separate outlet (not shown) for hydrocarbons, if present, and clean water.

Mounted within the vessel 10 is a manifold assembly comprised of a plurality of hollow manifolds, or conduits, arranged in the lower part of the vessel 10. The manifolds extend along substantially entire length of the vessel 10 in a generally horizontal orientation. Portions of the manifold assembly are positioned in a vertically spaced relationship to each other.

An upper manifold 20 is oriented substantially horizontally in the vessel 10 and extends from a first end 22, to the second end 24 of the vessel 10. The upper manifold 20 may consist of one or two independent sections. In the embodiment shown in FIG. 2, the upper manifold 20 is divided into a first, left portion 26 and a second, right portion 28. A middle manifold 21 may be similarly divided into a left portion 30 and a right portion 32. The lowermost manifold 34 may be formed as a unitary body forming a continuous conduit extending between the ends 22 and 24 of the vessel 10. Of course, each manifold may be formed as a unitary body, if desired. Similarly, each manifold may be formed from two or more sections of conduits, depending on the manufacturing preference.

Figure 4:
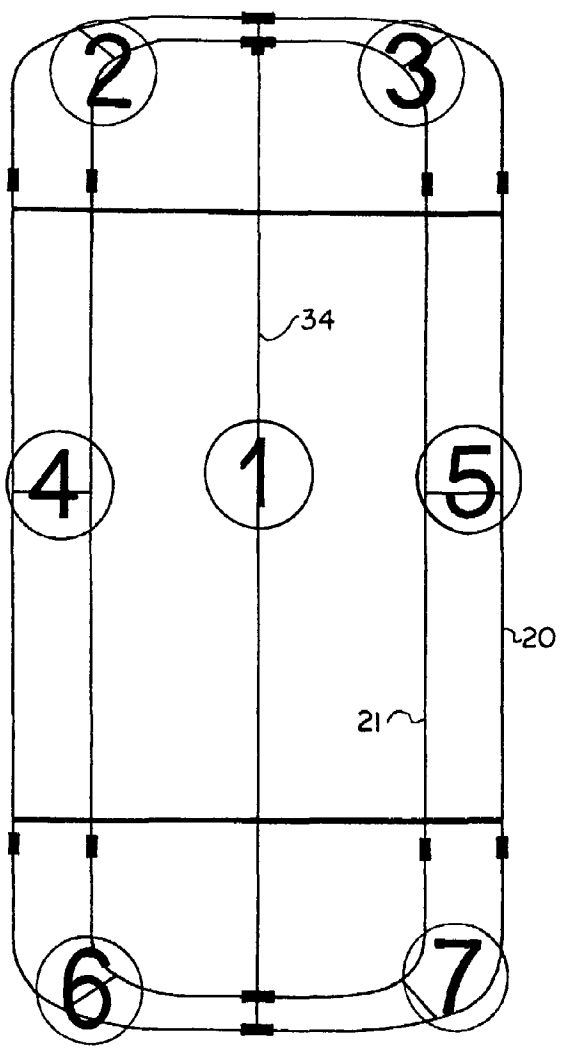
FIG. 4 is a schematic view showing sections of the manifold assembly that can assembled and disassembled on site.

Each of the manifolds 20, 21 and 34 is configured to fit the interior of a particular tank or vessel. Each manifold arrives disassembled at the job site and is reassembled inside the pre-determined tank/vessel. FIG. 4 schematically illustrates separate sections of the manifold assembly, 1 through 7, that can be manufactured off-site and then assembled in situ in the vessel 10.

Figure 2:
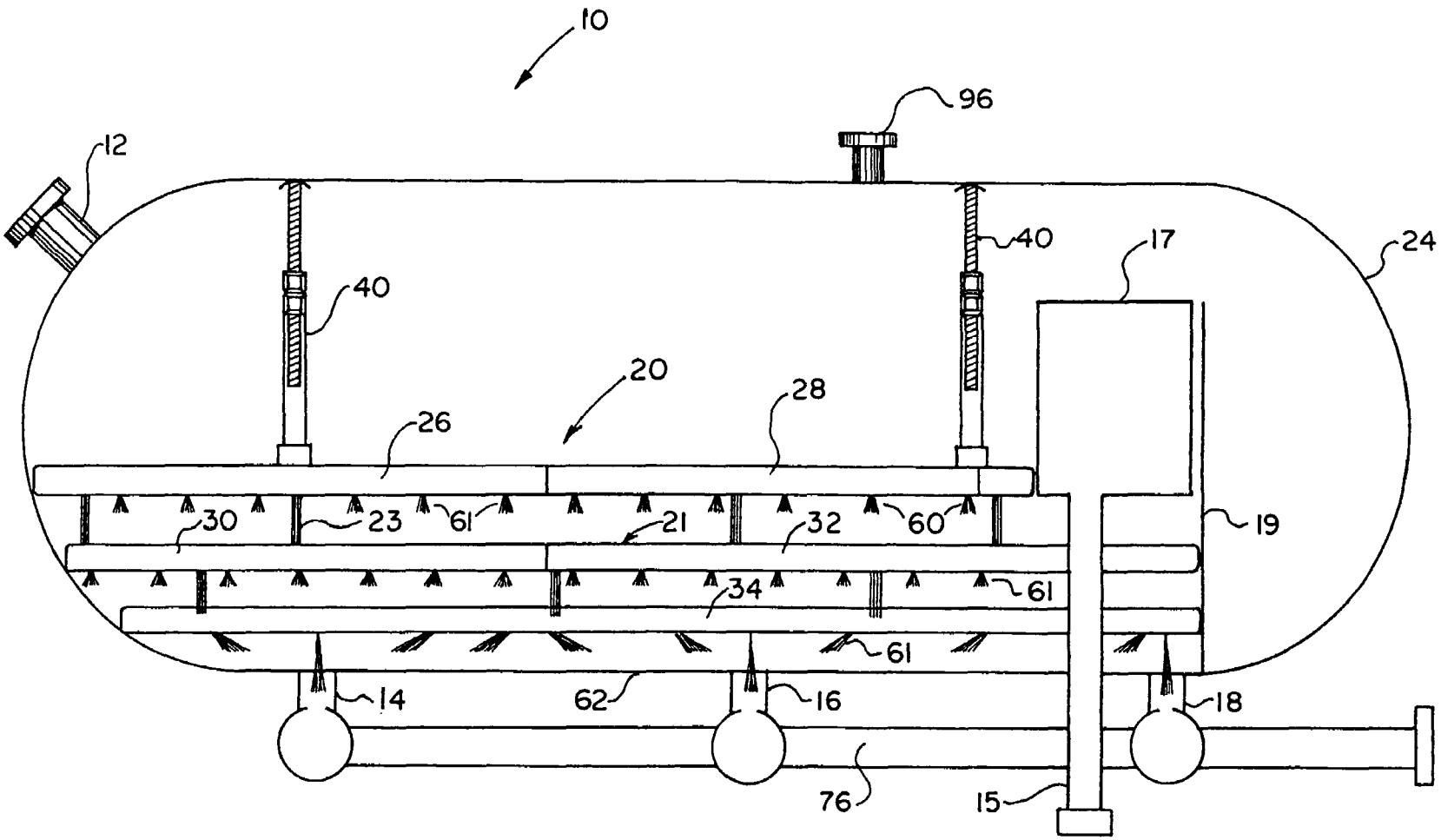
FIG. 2 is a schematic view showing jetting manifolds positioned inside a vessel.
Figure 8:
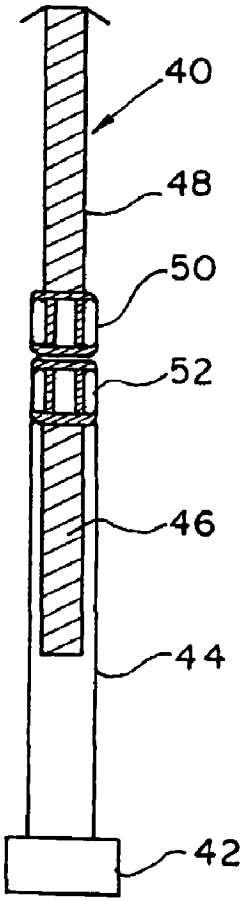
FIG. 8 is a detail view illustrating a tensioned rod used in the manifold support system of the present invention.
Figure 7:
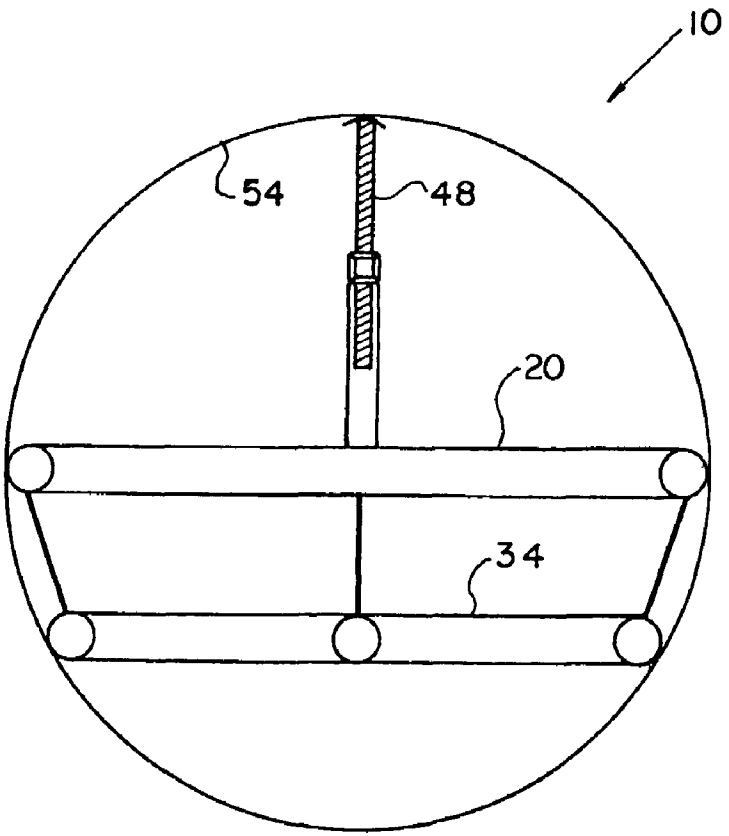
FIG. 7 is a schematic view of the manifolds held in place by a tensioned rod.

Each of the manifolds 20, 21 and 34 is retained in place by the manifold support system comprised of a plurality of tensioning rods 40, two of which are shown in FIG. 2. As shown in more detail in FIG. 8, each tensioning rod 40 comprises a manifold connection collar 42, which is fixedly attached to the respective manifold during fabrication. A hollow sleeve 44 extends outwardly from the collar 42 and receives a lower portion 46 of an externally threaded rod 48 therein, which is shown in more detail in FIGS. 7 and 8. A height adjustment member 50 is mounted over the threaded rod 48 to allow adjustment of the extension of the threaded rod 48 in and out of the sleeve 44.

A second, redundant height adjustment member 52 is provided below the height adjustment member 50. The second height adjustment member 52 may be a redundant feature to further insure the engagement of the rod 48 with the sleeve 44. When installed, the rod 48 urges against inner top wall 54 of the vessel 10. By rotating the threaded rod 48 and extending it to a required distance into or outwardly of the sleeve 44, an operator can secure position of the respective manifold inside the vessel 10. The ends of the manifold sections urge against inside surfaces of the end walls 22 and 24.

Figure 6:
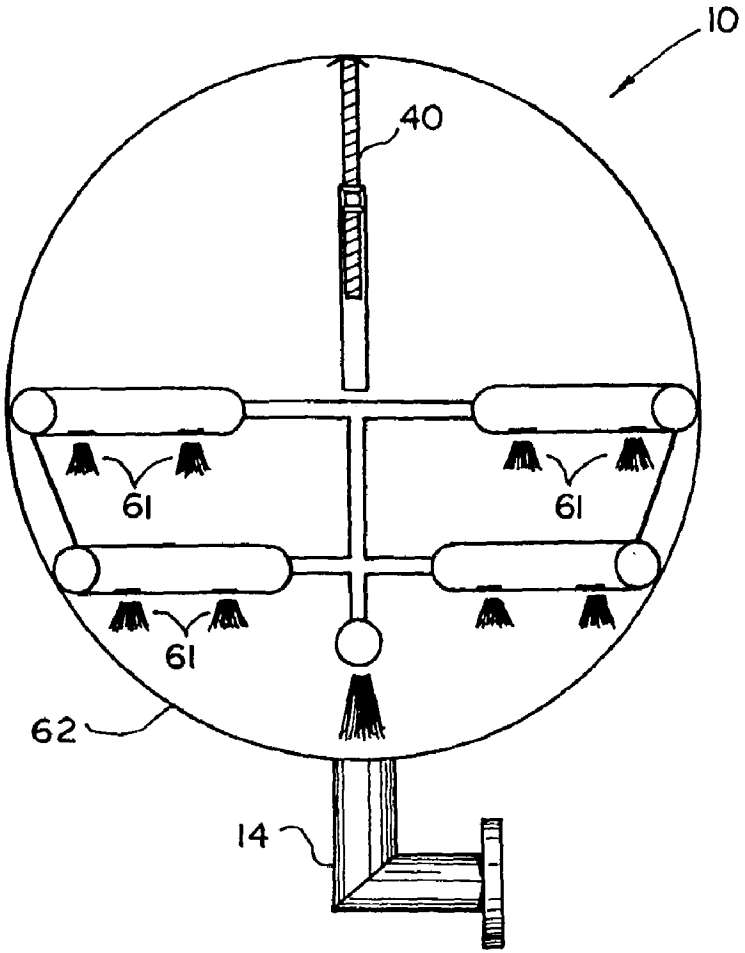
FIG. 6 is a schematic end view of the internal jetting manifold with a partial loop configuration.
Figure 5:
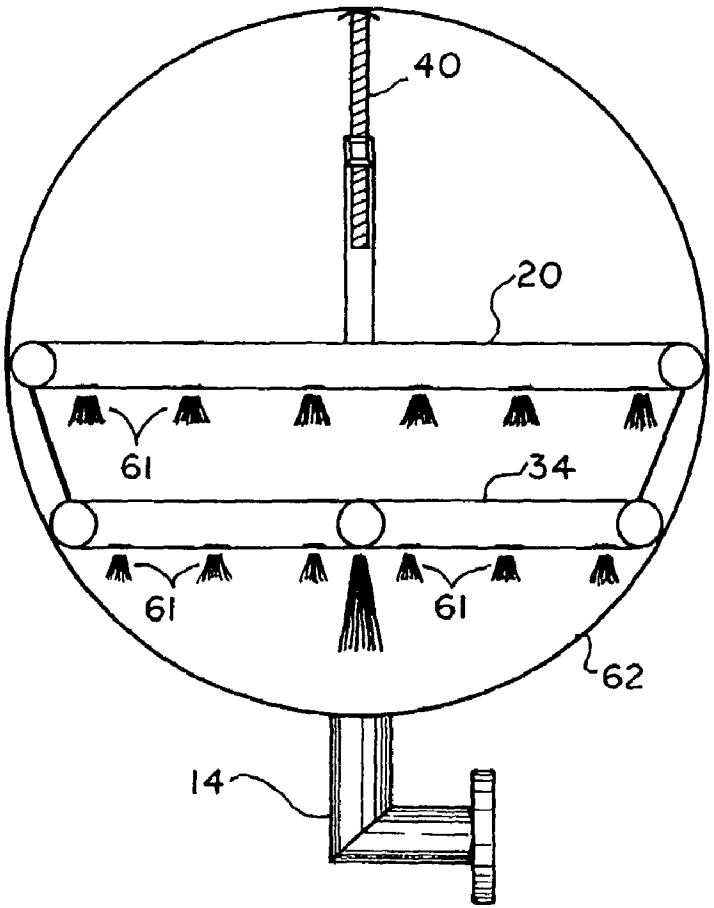
FIG. 5 is an end view of the internal jetting manifold with a full loop configuration.

Each manifold 20, 21 and 34 is provided with a plurality of downwardly facing jet openings 60, equipped with nozzles 61 which are configured for emitting a pre-determined quantity of a jetting fluid, often times salt water, into the vessel 10. The nozzles 61, shown in more detail in FIGS. 5 and 6, allow delivery of a fluid flow having pre-determined pressure and volume sufficient to move sand that settled on the lower wall portions of the vessel 10 towards the bottom 62 of the vessel 10.

Each manifold or individual manifold section is connected to a control valve positioned outside of the vessel 10, for instance on a dolly placed near the vessel 10. These valves are schematically illustrated in FIG. 1 and are designated as AV1, AV1, AV3, AV4, and AV5. The number of the control valves is dictated by the number of manifold sections that can be activated separately, depending on the amount of solids present in a particular part of the vessel 10. An infrared camera (not shown) may be introduced into the vessel 10 to send a video signal to the operator interface 70, where the operator can evaluate the presence and accumulation of the solids inside the tank 10. Each valve AV1–AV5 is controlled separately by an operator through the operator interface 70 and a control panel 72.

The operator determines the sequence of activation and the length of the jetting stream delivery into the vessel 10 by sending the command from the panel 72. For instance, the operator may initiate a jetting flow through a manifold 34 and program the length of the step for three minutes. The program will then shut off the valves for 3 minutes. Then the system will be activated again, delivering water through different set of nozzles for 3 minutes. This cycle of turning the valves on and off can be continued until all solids become dislodged from the walls of the vessel 10 and become "suspended" in the water. The suspended solids and water exit the vessel 10 through the outlet openings 14, 16, and 18. The outlets 14, 16, and 18 are fluidly connected to an exit conduit 76, which is in fluid communication with an extraction pump 94.

Once the operator either through experience, or trial, or pre-programming, determines that the solids are dislodged, the operator will cause the pump 94 to be activated and force the fluids and the suspended solids from the vessel 10. The extraction pump 94 is connected to solids separation devices, for instance hydro-cyclones 100 shown in FIG. 9. A conduit 102 connected to the extraction pump 94 allows the removed water and solids to be processed in the hydro-cyclones 100. The hydro-cyclones 100 are positioned above a vibratory screen shaker 104.

The water and solids is deposited by gravity on the screen shaker 104. The fine screen separates the sand and solids and moves them to a waste containment vessel 106. The jetting water, now free from sand and silt, moves by gravity through the screen of the shaker 104 to a re-injection reservoir 108 and then is re-injected into the vessel 10 using a high-volume pump 74 (FIG. 1). If desired, the re-circulated fluid can be forced through a filter to avoid re-introduction of minute solid particles into the system.

Figure 9:
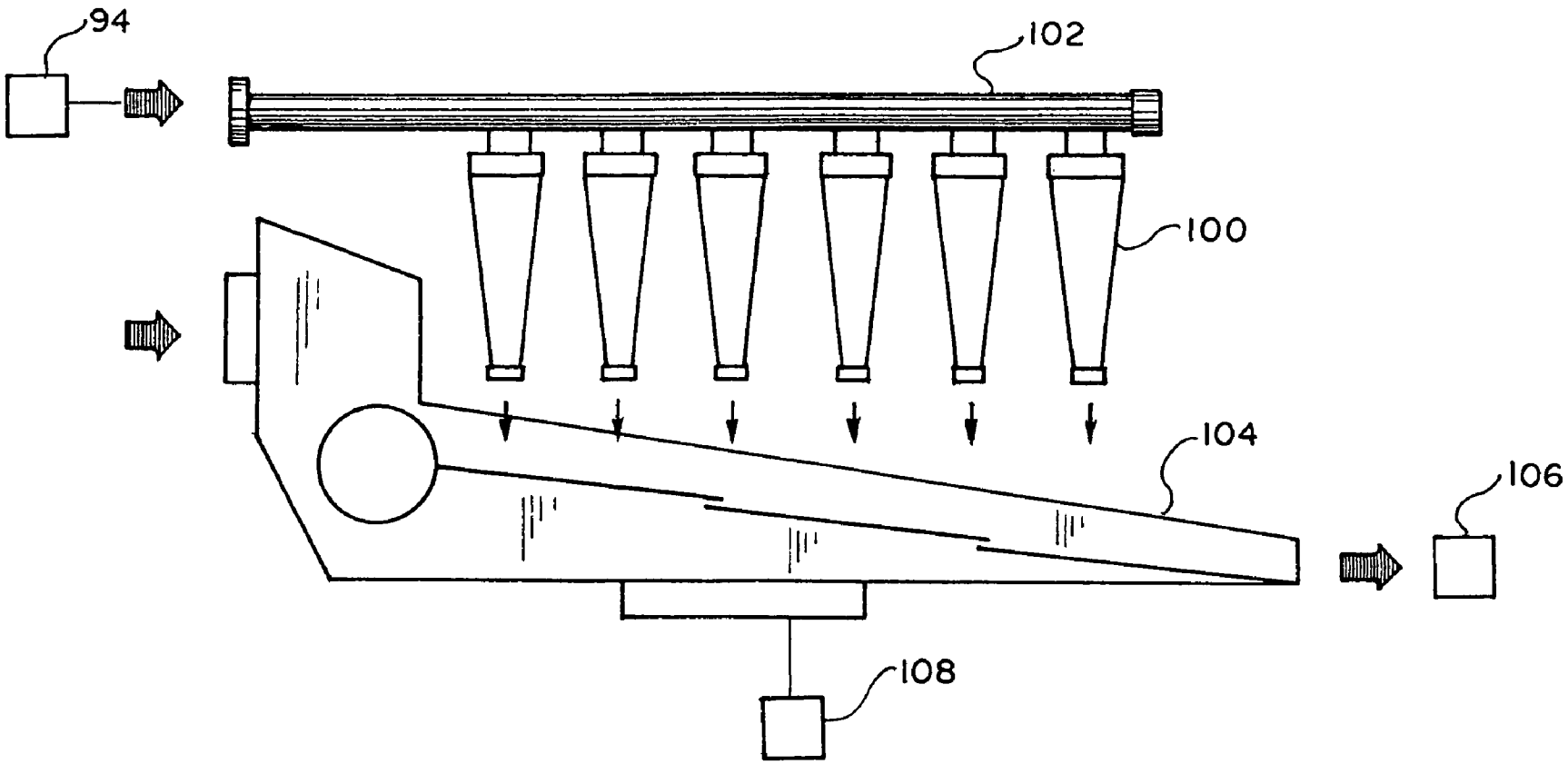
FIG. 9 is a schematic view illustrating final steps in the solids separation process.

The solids/fluid separator shown in FIG. 9 is not the only possible method of separating the removed solids from the solids-dislodging fluid. Other methods can be used as well. For instance, clarification, a method by which the sand and water matrix is allowed to settle over time can be used, as well as a cartridge, diatomaceous earth, bag style filters, and the like. The main objective of the using these methods is to prevent re-introduction of solids into the tank or vessel.

The batch cycles of the vessel cleaning continue until substantially all solids are removed from the vessel 10 and it is returned to normal operations. The process of solids separation may also be conducted on a continues basis. The vessel 10 may further contain an oil-collecting reservoir, with a separate exit opening, and clean water outlet. If desired, a separating wall may be provided in the vessel 10 near the end 24 to form a physical barrier to the solids and allow clean water to be removed from the vessel.

Figure 3:
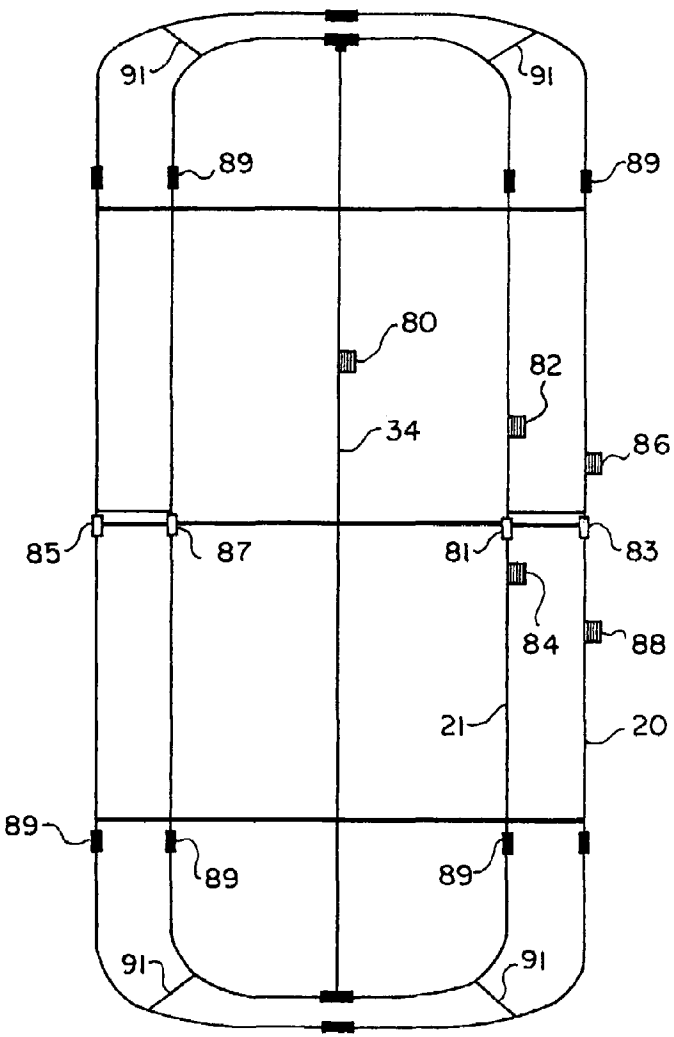
FIG. 3 is schematic view showing the fluid jetting manifolds and their inlet ports.

As shown in FIG. 3, each manifold or a section of a manifold is provided with a water inlet port. The manifold 34 is provided with a single unit port 80. The manifold 21, and if they are formed of two sections, can be provided with a pair of inlet ports 82, 84 and 86,88 respectively. The sequence of admitting water into the inlet ports can be controlled by the operator.

The manifolds 21 and 34 are further equipped with means for isolating sections of the manifold. These isolation means may comprise plugs 81, 83, 85 and 87. The plugs 81, 83, 85 and 87 retain the fluid circulation within a designated section of the manifold. The manifolds may be also provided with structural support fittings schematically shown in FIG. 3 and designated by numeral 89 in the drawings. To provide for structural strength, the manifolds may be connected by securing members, such as members 91 shown in FIG. 3.

Each individual manifold or a section of the jetting manifold is fluidly connected to a charge flange 90, which can be located in the location of a man hole. Each section of the manifold corresponds to a designated inlet port 92 on the charge flange 90. The charge flange 90 allows for access to the tank interior and is designed to hold internal liquid pressure within the vessel 10.

The pump 74 is designed to produce the adequate pressure and volume to charge the sections of the jetting manifolds with the pre-designated flow and pressure requirements. The jetting pump 74 circulates the fluids, including produced water and seawater through the vessel 10 and the associated manifolds. When using the pre-determined sequence of valve activation, the operator can create a liquid distribution of flow and pressure to the nozzle 61 that efficiently and inexpensively cleans the vessel 10 by removing the accumulated solids. The extraction pump 94 can be set up to activate automatically or manually to reduce or increase the flow coming from the vessel 10.

If the system does not use a pre-programmed sequence of the valve/pump operation, the operator can activate the valves and the pumps manually. Manual techniques, developed over time in a specific location can be then expressed in a computer-readable form and uploaded to the operator interface 70. Once the computerϕcontrolled protocol is established, the program's logic control (PLC) can take over the cleaning operation assuring consistent results and helping avoid human error.

The system of the present invention allows removal of sand from oil and gas separators, vessels and tanks under their normal operating conditions. The process uses solids-dislodging fluids, mainly saltwater, which is produced from the well along the oil and gas as a means of washing and/or moving sand from the vessel interior to the bottom of the vessel and then, by gravity, into the vessel drain system. A closed loop system allows introduction, removal and re-circulation of the solids-dislodging fluid, thereby saving valuable water resources.

Many changes and modifications can be made in the design of the present invention without departing from the spirit thereof. We, therefore, pray that our rights to the present invention be limited only by the scope of the appended claims.

I claim:

1. A method of removing solids settled in a container, comprising the following steps: providing a manifold assembly comprised of separate manifold sections with jet nozzles and positioning the manifold sections inside the container;

providing a valve assembly connectable to respective manifold sections, providing a means for controlling operation of the valve assembly according to a pre-programmed sequence wherein said control means comprises a data processing unit adapted to processing data related to solids accumulation in the container and generating a control signal for operation of the valve assembly according to the pre-programmed sequence;

providing an outlet conduit and connecting the outlet conduit to the manifold sections;

providing a means for moving solid particles and fluids removed from the container to a solid/fluid separator;

admitting a solids-dislodging fluid into the manifold sections and forcing the solids-dislodging fluid through the nozzles to contact the settled solids, thereby dislodging the solids;

removing a mixture of the dislodged solids and the solids-dislodging fluid from the container and transferring the mixture to a solid/fluid separator for separating solids from the mixture; and re-circulating solids-free fluid into the manifold sections.

2. The method of claim 1, further comprising a step of providing an extraction pump to facilitate removal of the mixture of the dislodged solids and the solids-dislodging fluid.

3. The method of claim 1, further comprising a step of providing a re-circulation pump for delivery of the solids-free fluid through the manifold assembly.

4. The method of claim 1, wherein said step of positioning the manifold sections inside the container comprises a step of supporting the manifold sections in a lower portion of the container in a generally horizontal orientation and in a spaced relationship to each other.

5. The method of claim 4, further comprising a step of providing a means for supporting the manifold sections in a pre-determined position inside the container.

6. The method of claim 5, wherein said means for supporting the manifold sections in a pre-determined position inside the container comprises a plurality of tensioned members urging against a top surface of the manifold sections and against a top wall of the container.

7. The method of claim 6, wherein each of said tensioned members comprises a supporting collar securely attached to a respective manifold section, a hollow sleeve attachable to the collar and a threaded rod, at least a portion of said threaded rod being engageable within said sleeve.

8. The method of claim 7, wherein each of said tensioned members further comprises a means for adjusting vertical extension of said threaded rod in relation to said sleeve.

9. The method of claim 8, wherein said means for adjusting vertical extension comprises a threaded nut mounted on said threaded rod above said sleeve.

* * * * *